US011756362B2

(12) United States Patent
Deckenbach et al.

(10) Patent No.: US 11,756,362 B2
(45) Date of Patent: Sep. 12, 2023

(54) METHOD AND SENSOR FOR TESTING DOCUMENTS

(71) Applicant: GIESECKE+DEVRIENT CURRENCY TECHNOLOGY GMBH, Munich (DE)

(72) Inventors: Wolfgang Deckenbach, Schechen (DE); Julia Danhof, Eglin a.d. Paar (DE); Ulf Ehrhardt, Munich (DE); Martin Clara, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 216 days.

(21) Appl. No.: 16/973,611

(22) PCT Filed: Jun. 17, 2019

(86) PCT No.: PCT/EP2019/000189
§ 371 (c)(1),
(2) Date: Dec. 9, 2020

(87) PCT Pub. No.: WO2019/242879
PCT Pub. Date: Dec. 26, 2019

(65) Prior Publication Data

US 2021/0248855 A1 Aug. 12, 2021

(30) Foreign Application Priority Data

Jun. 20, 2018 (DE) ..... 10 2018 004 884.6

(51) Int. Cl.
*G07D 7/1205* (2016.01)
*G07D 7/121* (2016.01)

(52) U.S. Cl.
CPC ..... *G07D 7/1205* (2017.05); *G07D 7/121* (2013.01)

(58) Field of Classification Search
CPC ..... G07D 7/121; G07D 7/1205
See application file for complete search history.

(56) References Cited

U.S. PATENT DOCUMENTS 9,460,579 B2 10/2016 Deckenbach et al.
2009/0224048 A1* 9/2009 Hasegawa ..... C09K 11/06 235/491

(Continued)

FOREIGN PATENT DOCUMENTS

DE 102008044883 A1 3/2010
DE 102011117678 A1 5/2013
WO WO-2017118466 A1 * 7/2017 ..... G07D 7/12

OTHER PUBLICATIONS

Search Report from DE Application No. 102018004884.6, dated Mar. 26, 2019.

(Continued)

*Primary Examiner* — Uzma Alam
*Assistant Examiner* — Huy Phillip Pham
(74) *Attorney, Agent, or Firm* — WORKMAN NYDEGGER

(57) ABSTRACT

A method and a sensor for checking documents are provided in which the same detector is used for a remission measurement and a luminescence measurement of the value document. The remission measurement value being detected during the illumination of the value document with an excitation light used for luminescence excitation, and the luminescence measurement value after switching off the illumination. In order to reduce a distortion of the remission measurement value by the luminescence, a spectral detection filter is incorporated into the detection ray path, which has a transmission of at least 0.5% in the spectral region of the excitation light. The increased transmission of the spectral detection filter achieves that the excitation intensity impinging on the detector far exceeds the luminescence (Continued)

intensity occurring simultaneously with the excitation and thus reduces the mentioned distortion.

16 Claims, 4 Drawing Sheets

(56) References Cited

U.S. PATENT DOCUMENTS

| | | | | |
|---|---|---|---|---|
| 2014/0293271 | A1* | 10/2014 | Deckenbach | G01J 3/36<br>250/208.2 |
| 2016/0125682 | A1 | 5/2016 | Rapoport et al. | |
| 2021/0019976 | A1* | 1/2021 | Kerst | G07D 7/205 |

OTHER PUBLICATIONS

International Search Report and Written Opinion from PCT Application No. PCT/EP2019/000189, dated Aug. 28, 2019.

* cited by examiner

METHOD AND SENSOR FOR TESTING DOCUMENTS

BACKGROUND

The invention relates to a method and a sensor for checking documents, e.g. value documents, in particular for checking the authenticity of documents, e.g. value documents.

From the prior art, different methods are known for recognizing forged value documents. For checking the authenticity of value documents, in particular of bank notes, these can be checked as to their luminescence properties. Fluorescence and/or phosphorescence can contribute to luminescence. For detecting fluorescence and/or phosphorescence, measurement values are detected after the end of an excitation light pulse, e.g. in the dark phase between two excitation light pulses.

For distinguishing authentic value documents from forgeries, e.g. the luminescence of an examined value document is checked. The forged value documents to be recognized may be composed forgeries which are assembled from parts of different value documents. The composed forgeries may be assembled from parts of authentic and forged value documents. For recognizing composed forgeries, there are many suggestions with which some composed forgeries are recognizable but others not.

There is a possibility for recognizing composed forgeries if the substrate of the authentic value document is furnished with a luminescent substance over the full area, however the forged section of the composed forgery has been manufactured from a non-luminescent substrate. Such a composed forgery can be recognized by the fact that the luminescence is not present over the full area, but is missing in some parts of the composed forgery (in the forged section of the composed forgery).

For judging the luminescence measurement values, these are considered, for example, in comparison with the remission measurement values of the value document. For this purpose, it is desirable to compare the intensity of the luminescence with the intensity of the remission of the value document at respectively the same position of the value document as possible. Up to now, an additional detector is required for the remission measurement of a value document, which must be provided in addition to the luminescence detector. With an additional detector, however, the measurement of remission and luminescence at the same position of the value document is difficult, especially when the value document, for its check, is transported through the capture regions of the two detectors used one after the other—as is usually the case.

SUMMARY

It is therefore an object of the invention to improve the detection of luminescence and remission from the same document.

The invention is explained below using the example of value documents, but it is not limited to value documents and also suitable for other documents.

To improve the measurement of remission and luminescence from the same value document, it is proposed to use the same detector for the remission measurement and the luminescence measurement of the value document, this detector detecting the remission measurement value during the illumination of the value document with an excitation light used for luminescence excitation and this detector detecting the luminescence measurement value after the illumination is switched off. For the remission measurement of the value document, the remission of the excitation light irradiated for the luminescence measurement is detected. The excitation light is thus used both for exciting the luminescence and as illumination light for remission measurement. Since one and the same detector is used for the detection of the remission measurement value and the luminescence measurement value, remission and luminescence measurement can be performed at nearly the same value document position. This is possible both statically, i.e. without relative movement between value document and detector, and also in the case when the value document and the detector are transported relative to each other. In the latter case, for this purpose, the points in times of the measurement for the remission and the luminescence measurement here should follow each other in short succession. Since only one detector is used for the detection of the remission measurement value and the luminescence measurement value, one can do without an additional detector for the remission measurement.

However, in such a remission measurement during illumination with excitation light, the remission measurement value may be distorted by luminescence occurring simultaneously with the remission (with a quickly rising luminescence of e.g. organic luminescent substances). In such cases, during the illumination with excitation light, a superimposition of remission and luminescence is detected. The remission measurement value detected during illumination with excitation light then contains a portion of the remission intensity and a portion of the luminescence intensity. A quantitative evaluation of the remission measurement value is made difficult due to the distortion by the luminescence occurring simultaneously with the illumination. In order to determine the actual portion of remission (without the superimposed luminescence detected) from the distorted remission measurement value, a subsequent calculation could be considered (e.g. subtracting the luminescence portion from the measurement value). However, this proves to be difficult when the amount and the time course of the luminescence are not known.

The invention is based on the idea of decreasing the distortion of the remission measurement value due to the luminescence (occurring simultaneously with the remission) by not blocking the excitation light in the detection ray path as strongly as possible—as is usually the case—but by allowing a part of the excitation light to pass through to the detector. This achieves that the portion of the excitation intensity impinging on the detector far exceeds the luminescence intensity occurring simultaneously with the excitation. Because with a same illumination intensity or excitation intensity of the value document, then a significantly increased remission intensity is detected, while the detected luminescence intensity remains the same (since the excitation intensity impinging on the value document remains unchanged). The relative portion of the remitted excitation intensity in the remission measurement value detected during illumination thus grows strongly compared to the relative portion of luminescence. The remission measurement value detected during illumination is therefore no longer or only slightly distorted by the luminescence emitted during illumination with excitation light.

The sensor used for checking documents, e.g. value documents, comprises:

an illumination device for illuminating a document, e.g. a value document, with one or several excitation light pulses of an excitation light which is suitable for exciting the document, e.g. value document, to emit luminescent light, and a detector for detecting at least one remission measurement value of the document, e.g. value document, at at least one point in time at which the document, e.g. value document, is illuminated with an excitation light pulse of the excitation light, and for detecting at least one luminescence measurement value of the document, e.g. value document, at at least one point in time after the end of the respective excitation light pulse, and a detection filter which is located in a detection ray path formed between the document, e.g. value document, and the detector, and a control device for controlling the illumination device and the detector, and an evaluation device for checking the document, e.g. value document, on the basis of the at least one remission measurement value detected by the detector and on the basis of the at least one luminescence measurement value detected by the detector, in particular for checking the authenticity of the document, e.g. value document.

In the sensor, the same detector is used for capturing both measurement values, i.e. the remission measurement value and the luminescence measurement value. If the detector comprises several sections that can be read out separately, for the capture of both measurement values respectively the same detector sections are illuminated and read out. The luminescence of the security feature to be detected can be a phosphorescence and the respective luminescence measurement value can be a phosphorescence measurement value of the value document.

The spectral detection filter located in the detection ray path has a transmission of at least 0.5% in the spectral region of the excitation light. The maximum of the transmission spectrum in the spectral region of the excitation light is at least 0.5%. This increased transmission of the spectral detection filter achieves that the excitation intensity impinging on the detector far exceeds the luminescence intensity occurring simultaneously with the excitation. Preferably, the spectral detection filter has a transmission in the region of 0.5% to 20%, preferably in the region of 1% to 10%, in the spectral region of the excitation light.

In contrast, the luminescence sensors used so far usually have a blocking filter installed in the detection ray path between value document and detector, which only allows the luminescence light to pass through and blocks as far as possible all spectral regions that are not to be detected, i.e. also blocks the excitation light nearly completely. For example, here a blocking filter is used which reduces in targeted fashion the spectral region of the excitation light by a factor of $10^4$ to $10^6$ in order to achieve that only luminescence is measured, as possible.

The invention is utilizable for any kind of value document check, in which both remission measurement values and luminescence measurement values of a value document are evaluated. Particularly advantageously, the invention makes possible an improved detection of remission measurement values and luminescence measurement values at nearly the same value document position in order to compare these measurement values with each other. This can be utilized within the framework of an authenticity check whose target is to find composed forgeries, but also for other authenticity checks in which the luminescence of the value document is checked. The luminescent substance to be checked may be present over the full area of the value document or in the substrate of the value document, or it may only be present in one or several partial regions.

The spectral detection filter transmits only a portion of the excitation light remitted by the value document. The excitation light remitted by the value document is partially absorbed or reflected by the spectral detection filter. The spectral detection filter transmits at least a portion of 0.5% of the excitation light impinging on the spectral detection filter which was remitted by the value document, but preferably at most a portion of 20% of the excitation light impinging on the spectral detection filter which was remitted by the value document.

However, the luminescent light of the value document is preferably transmitted nearly completely through the spectral detection filter. In the spectral region of the luminescent light of the value document, the spectral detection filter preferably has a transmission of at least 80%. The maximum of the transmission spectrum in the spectral region of the luminescent light is at least 80%. Preferably, the maximum transmission which the spectral detection filter has in the spectral region of the luminescent light is at least by a factor of four greater than the maximum transmission that it has in the spectral region of the excitation light.

The spectral detection filter differs from usual neutral-density filters in that its transmission depends on the wavelength of the light impinging on the spectral detection filter (i.e. its transmission spectrum is not uniform over all wavelengths). For example, the spectral detection filter is a bandpass filter with at least two transmission bands, in particular an interference filter.

In some embodiment examples, the spectral detection filter has a transmission spectrum which has one (spectral) luminescence transmission band in the spectral region of the luminescent light of the value document and one or several additional (spectral) transmission bands in the spectral region of the excitation light. The luminescence transmission band spectrally overlaps with the luminescence light of the value document. The luminescence transmission band may spectrally partially overlap with the luminescence light of the value document or spectrally completely enclose this. The at least one additional transmission band spectrally overlaps with the excitation light. The transmission spectrum of the spectral detection filter may e.g. have an additional transmission band that spectrally completely encloses the excitation light. Alternatively, the additional transmission band/s may partially spectrally overlap with the excitation light.

The luminescence transmission band and the at least one additional transmission band for example are spectrally separated from each other (in particular spectrally non-overlapping). As an alternative to transmission bands spectrally separated from each other, the transmission spectrum of the spectral detection filter—with corresponding modulation of the transmissivity—can also continuously extend from the spectral region of the luminescent light to the spectral region of the excitation light.

In its luminescence transmission band, the spectral detection filter preferably has a higher transmission than in its additional transmission band/s. For example, the maximum transmission in its luminescence transmission band is at least by a factor of 4 greater than the maximum transmission in the at least one additional transmission band.

Laterally (in the plane of the detection filter), the detection filter has in particular a uniform spectral transmission. Each lateral section of the spectral detection filter thus has the same spectral transmission. Through the spectral detection filter there is transmitted—respectively at the same lateral position of the detection filter—both the luminescent light of the value document impinging on the spectral detection filter and at least 0.5% of the excitation light impinging on the spectral detection filter (remitted from the value document). The spectral detection filter thus transmits the luminescence light impinging thereon and the excitation light impinging thereon independent of the lateral position along the spectral detection filter. For example, the spectral detection filter has the luminescence transmission band and the at least one additional transmission band respectively at the same lateral position along the spectral detection filter.

Preferably, the at least one additional transmission band spectrally has a distance of at least 10 nm, preferably at least 20 nm, from the at least one luminescence transmission band. As the spectral distance of the transmission bands there is denoted here the spectral distance of the two half-value points of the transmission spectrum that are spectrally closest to each other, at which the transmission of the respective transmission band has dropped to 50% of the maximum value of the respective transmission band.

For example, the spectrum of the excitation light may have a spectral excitation band that has an upper spectral flank (long-wave side of the spectrum) and a lower spectral flank (short-wave side of the spectrum). In some embodiment examples, the spectral detection filter has a first additional spectral transmission band that is spectrally located in the lower spectral flank of the excitation band and a second additional spectral transmission band that is spectrally located in the upper spectral flank of the excitation band. The advantage of additional spectral transmission bands in both spectral flanks of the excitation band is that this compensates for a spectral shift of the excitation light during the measurement (e.g. due to temperature), i.e. a temperature drift of the excitation band has little or no influence on the level of the excitation intensity transmitted through the spectral detection filter. The same advantage is achieved when the additional spectral transmission band of the spectral detection filter spectrally completely encloses the excitation band of the excitation light.

With some sensors it is usual that the value document is transported relative to the detector during detection, e.g. is transported past the same. This can be effected with relatively low speed of 0.1-1 m/s, but preferably with high speed of 1-15 m/s. During transporting the value document, the respective remission measurement value is then detected in a first detection region of the value document and the respective luminescence measurement value, which is detected immediately after the remission measurement value, is detected in a second detection region of the value document. The remission measurement value is detected at a point in time at which the respective first detection region is illuminated with an excitation light pulse of the excitation light. The respective luminescence measurement value is detected at a point in time at which the second detection region is no longer illuminated with an excitation light pulse of the excitation light.

The time interval between detecting the remission measurement value and detecting the luminescence measurement value is preferably selected such that the respective first and second detection region, whose first and second measurement value are detected immediately after each other, overlap in terms of area (measured by their area on the value document) by at least 50%, preferably by at least 80%.

The relatively large transmission of the spectral detection filter in the spectral region of the excitation light leads to the fact that the detector detects an increased intensity during illumination with excitation light, which usually far exceeds the luminescence intensity. In the case of slowly rising luminescent substances (or low distortion of the remission measurement value) and low transport speeds, the transmission of the detection filter in the spectral region of the excitation light is not required to be as high as in the case of a high distortion. In these cases, usual photodetectors, amplifying circuits and A/D converters are suitable for determining both the low intensity of the luminescent light when the illumination is switched off and the intensity of the excitation light during illumination. The detector detects the respective remission measurement value and the respective luminescence measurement value with the same sensitivity. The dynamic region of the measurement is then large enough that both the remission measurement value and the luminescence measurement value can be detected without overdrive. In particular, the transmission of the spectral detection filter is selected such that it is somewhat lower in the spectral region of the excitation light than a that transmission from which the intensity of the excitation light transmitted through the detection filter overdrives the detection. In order to have as large a dynamic region as possible available for the measurement of the two measurement values, preferably one or several photodiodes of the material systems Si, Ge, InAs or InGaAs are used as detectors. The photocurrents detected therewith can be processed with a transimpedance converter of suitable amplification as well as subsequent digitization with a sufficiently large dynamic region. Preferably this is effected linearly over the dynamic region.

If the luminescent substance of the bank note to be detected rises quickly over time (i.e. strongly distorts the remission measurement value), a relatively large transmission of the detection filter in the spectral region of the excitation light is required to keep the distortion low. However, this leads to a relatively high intensity for the remission measurement value during illumination with excitation light. If, in such a case, during detection the dynamic region, in particular the dynamic region of the amplifier circuit and/or of the A/D converter, is not sufficient (so that during the detection of the remission measurement value the measurement value goes into saturation), a capture of the measurement signals is performed with different sensitivities. For remission measurement during illumination with excitation light, the sensitivity of the detector is reduced. The remission measurement value detected by the detector and the luminescence measurement value detected by the detector can be measured with different sensitivity, the remission measurement value being measured with lower sensitivity than the luminescence measurement value.

The control device may be arranged to switch the detector or an electronic circuit connected therewith (e.g. amplifier circuit) such that the remission measurement value is measured with lower sensitivity than the luminescence measurement value. For example, in the time period between the detection of the respective remission measurement value and the respective luminescence measurement value, a sensitivity setting of the detector or of an amplifier connected with the detector or of a current-voltage converter connected with detector can be switched over such that the remission measurement value is measured with lower sensitivity than the luminescence measurement value. In particular, in the time period between the detection of the respective remission measurement value and the respective luminescence measurement value, the bias voltage of the detector, or the amplification of the electronic amplifier which amplifies the output signal of the detector, or the transimpedance of a current-voltage converter connected with the detector can be switched over in such a way that the remission measurement value is detected with lower sensitivity than the luminescence measurement value. The sensitivity can be switched over by a switching signal of the control unit, which is generated e.g. synchronously with the excitation light pulses. Preferably, the sensitivity setting of the detector is switched over immediately before the start of the excitation light pulse such that the remission measurement value is detected with lower sensitivity than the luminescence measurement value, and switched back again immediately after the end of the excitation light pulse for the detection of the remission measurement value. The sensitivity can be switched over with a switchover time of 50 μs to 1 ms, preferably with a switchover time of 70 μs to 300 μs.

The control device may be a processor which is programmed with corresponding software for controlling the illumination device and the detector. The processor can also be configured to generate a control signal that switches over the sensitivity of the detector. The evaluation device can also be a processor which is programmed with corresponding software for evaluating the remission and luminescence measurement values. The processor is arranged e.g. for analyzing the measurement signals and for assessing the authenticity and outputs the result of the authenticity evaluation or forwards it for further processing. The control device and the evaluation device may be different devices or may be formed by the same device, which is arranged both for controlling the illumination device and the detector as well as for checking the value document on the basis of the at least one remission measurement value detected by the detector and on the basis of the at least one luminescence measurement value detected by the detector. For example, the same processor can be used for both.

The detector is in particular a semiconductor-based detector, e.g. a photodiode, preferably with a charge carrier lifetime of at most 20 μs. Despite intensive irradiation with excitation light, the detector is then again capable of detecting low intensities after a short time. This allows a quicker measurement or a short time interval between the two measurements and thus a large spatial overlap of the detection regions, especially in case of high transport speeds of the value document.

The invention also relates to a method for checking documents, e.g. value documents, in particular for checking the authenticity of the documents or value documents, comprising the steps of:

- illuminating a document, e.g. value document, with one or several excitation light pulses of an excitation light which is suitable for exciting the document, e.g. value document, to emit luminescent light,
- detecting at least one remission measurement value of the document, e.g. value document, at at least one point in time at which the document, e.g. value document, is illuminated with an excitation light pulse of the excitation light, by means of a detector,
- detecting at least one luminescence measurement value of the document, e.g. value document, at at least one point in time after the end of the respective excitation light pulse, by means of the detector,
- checking the document, e.g. value document, on the basis of the at least one remission measurement value detected by the detector and on the basis of the at least one luminescence measurement value detected by the detector.

When detecting the remission measurement value and the luminescence measurement value, in a detection ray path formed between the value document and the detector there is located a spectral detection filter, the spectral transmission of which is selected such that through the detection filter there is transmitted both the luminescent light of the value document impinging on the spectral detection filter and at least 0.5% of the excitation light impinging on the spectral detection filter which has been remitted by the value document.

The evaluation can be effected based on one single discrete remission or luminescence measurement value or based on several of the respective measurement values which are offset against each other (e.g. averaged). The measurement values can be detected at discrete points in time, or they can be detected by a timewise integration over a time section within the respective excitation pulse (for the remission measurement value) or after the end of the respective excitation pulse (for the luminescence measurement value). Between each two excitation light pulses, also two or more luminescence measurement values can be detected, each with a different time interval from the respective excitation light pulse, and these luminescence measurement values can be used for checking the value document, e.g. can be offset against each other.

The value document and the detector can be moved relative to each other and the illumination can be switched on and off alternately along the value document. Alternatively, illumination and detection can also be performed without relative movement.

The documents whose authenticity is checked with the method and the sensor according to the invention are in particular value documents, for example bank notes, tickets, cheques, coupons, vouchers, etc. However, with the method according to the invention and the sensor also other documents, e.g. identity documents, can be checked.

For performing the method according to the invention, a device for checking documents, e.g. value documents, can be used which has the above-mentioned sensor for checking (and other sensors, where applicable). The device may be configured for processing, e.g. for checking the authenticity of and/or for sorting, value documents. In particular, the device may have a transport device which is arranged to transport the document, e.g. value document, and the detector or the sensor having the detector relative to each other during detection, e.g. to transport the value document past the sensor or detector. The control device of the sensor may be arranged to drive the detector such that the respective remission measurement value and the respective luminescence measurement value are detected with such a small time interval between each other that the detection regions on the document, e.g. value document, from which the respective remission measurement value and the respective luminescence measurement value are detected, overlap by at least 50%, preferably by at least 80%.

BRIEF DESCRIPTION OF THE DRAWINGS

Hereinafter the invention will be described by way of example with reference to the accompanying drawings. There are shown.

DETAILED DESCRIPTION OF VARIOUS EMBODIMENTS

The invention is hereinafter explained using the example of the authenticity check of a bank note 3, in whose substrate a luminescent substance is incorporated over the full area, the luminescence of which is evaluated for the authenticity check. The bank note of FIG. 2*a* viewed in this example has—in addition to the luminescent substance—an imprint of fluorescent printing ink 11. In addition, the denomination 13 is printed on the bank note and furnished with a region with non-fluorescent printing ink 12.

Figure 1:
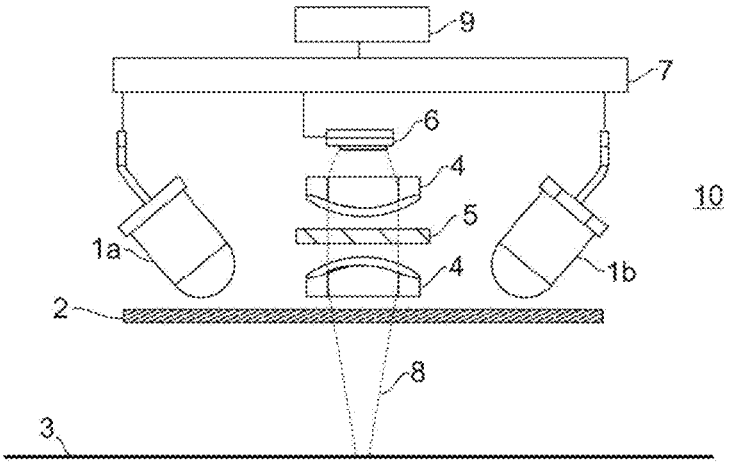
FIG. 1 schematic structure of a sensor according to the invention.
Figure 2A:
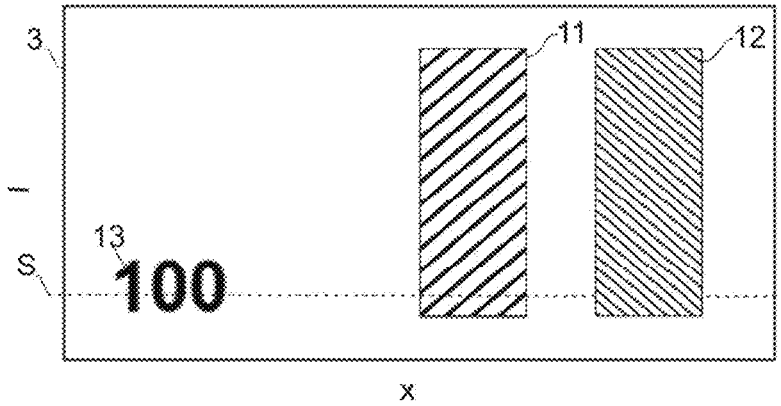
FIG. 2*a* example of a bank note with fluorescent printing ink.

FIG. 1 shows a sensor 10 which is arranged for capturing both remission measurement values and luminescence measurement values of a value document, such as e.g. the bank note 3 of FIG. 2*a*. The bank note 3 is transported along a direction (e.g. in FIG. 1 from right to left) past the sensor 10 with the aid of a transport device, so that the detector 6 can detect several measurement values one after the other as a function of the position x along the bank note 3. For the measurement of the remission and luminescence of the bank note the same detector 6 is used.

In one embodiment, the sensor 10 has an illumination device with two light emitting diodes 1*a* and 1*b* which illuminate the bank note 3 from an oblique direction. The spectral region of the illumination device is selected such that the light emitted by the illumination device is configured for optically exciting the luminescent substance present over the full area of the bank note. The illumination device is switched on and off periodically to excite the bank note 3 to luminescence at a multiplicity of positions x along the bank note with excitation light pulses. In the detection ray path 8 of sensor 10, the light emanating from the bank note 3 passes through a front glass 2, then a lens 4, a spectral detection filter 5 and another lens 4, which directs the light to the detector 6. The spectral detection filter 5 is used for attenuating the excitation light A. The sensor 10 further has a control device 7 which ensures that the illumination device is periodically switched on and off, triggers the detection of the remission and luminescence measurement values at certain points in time and passes on the remission and luminescence measurement values detected by the detector to the evaluation device 9 which performs an authenticity check on the basis of the remission and luminescence measurement values.

Figure 3A:
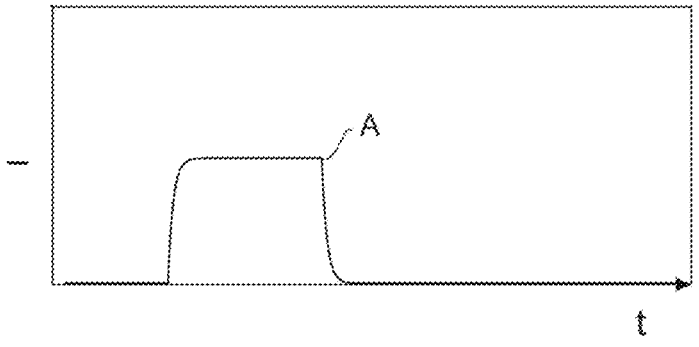
Figure 5:
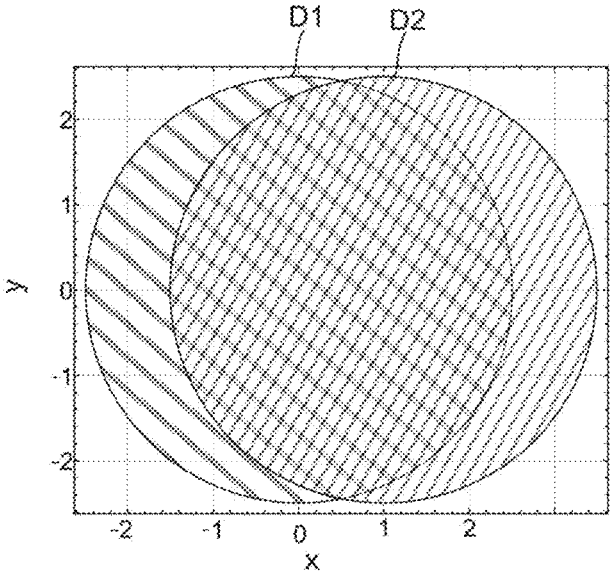

The excitation light A of the illumination device is used both for exciting the luminescence of the luminescent substance present over the full area and as illumination light for the remission measurement. During the illumination with an excitation light pulse used for the luminescence excitation, see FIG. 3*a*, the detector 6 detects a remission measurement value. After the end of the respective excitation light pulse, the detector 6 detects a luminescence measurement value. In order to achieve a measurement of the remission and luminescence of the bank note at the same value-document position as possible, the remission measurement value and the luminescence value are detected with the as small as possible time interval between each other. In this way, remission and luminescence measurement can be performed at nearly the same value document position x. Preferably, the detection region of the remission measurement (first detection region D1) and the detection region of the luminescence measurement (second detection region D2) overlap by at least 80% in terms of area, see FIG. 5.

Figure 3B:
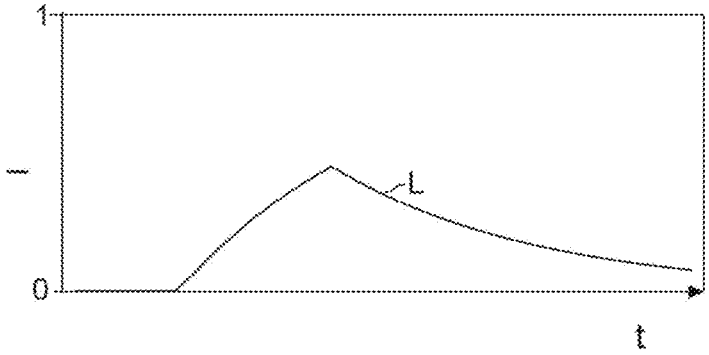

Since the remission measurement is performed during illumination with excitation light A, the remission measurement value may, however, be distorted by a luminescence occurring simultaneously with the remission. Thus, a quick rising luminescence, as shown in FIG. 3*b*, leads to an erroneous increase in the remission measurement value. During the illumination with excitation light, in such cases a superimposition of remission and luminescence is detected, see FIG. 3*c*. The remission measurement value detected during illumination with excitation light in such a case does not result from the remission intensity alone, but also contains a portion of luminescence intensity. The remission measurement value used for checking the authenticity can therefore be distorted by a luminescence occurring simultaneously with the illumination.

Figure 2B:
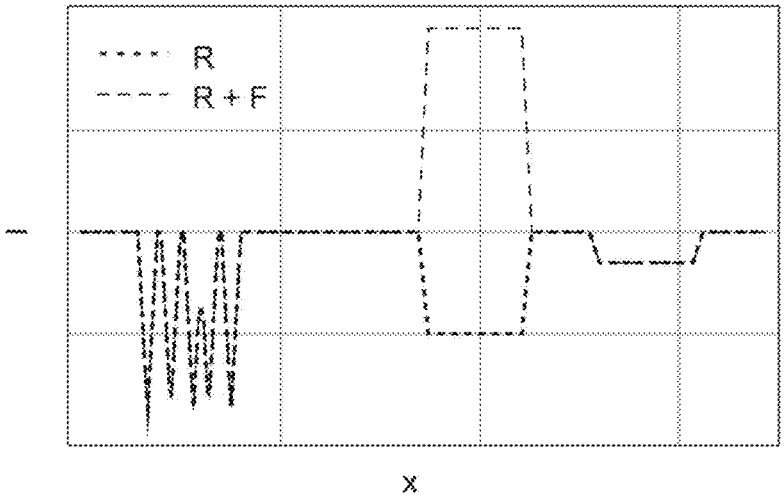
FIG. 2*b* the course of the remission intensity R and fluorescence intensity F emanating from the bank note of FIG. 2*a* as a function of the position x along the bank note, FIG. 3*a-d* the time course of the excitation intensity (FIG. 3*a*), the luminescence intensity of the bank note (FIG. 3*b*), the superimposition of luminescence intensity and detected (with high suppression) excitation intensity (FIG. 3*c*), the superimposition of luminescence intensity and detected (with low suppression) excitation intensity (FIG. 3*d*), FIG. 4*a-e* five examples of transmission spectra of the spectral detection filter compared to the spectral location of the excitation light and the luminescent light, FIG. 5 two-dimensional location of the first and second detection region on the bank note, FIG. 6 electrical circuit for switching over the sensitivity during detection.

In addition, the remission measurement value may also be distorted by the fact that a quick rising additional fluorescence is detected, such as that of the fluorescent ink 11, which the bank note emits only in the region of the fluorescent ink 11 in response to the excitation light pulse of the excitation light A, see FIGS. 2*a* and 2*b*. In FIG. 2*b* there is outlined the remission intensity R emanating from the bank note 3 along a line S as a function of the position x along the bank note. In the region of the nominal value 13 and the non-fluorescent printing ink 12 there results a lower remission intensity than outside the printed regions. In the region of the fluorescent printing ink 11 the remission of the bank note is also suppressed. However, in this region from the bank note 3 there emanates—in addition to the remission—the fluorescence F of the fluorescent printing ink 11, which significantly increases the measurement value detected in this region. At the x-position of the fluorescent printing ink 11, it thus additionally comes to an erroneous increase in the remission measurement value detected during illumination with excitation light.

The remission measurement values MR detected during illumination with excitation light can thus be distorted both in the case of a quickly rising luminescent substance applied over the full area and by an additional fluorescence F of other locally applied inks or fluorescent substances.

For checking the authenticity of the bank note 3, for example, the luminescence measurement values of a luminescent substance incorporated over the full area of the substrate are examined and in doing so compared with the remission measurement values of the bank note. If the distorted remission measurement values are now used for this comparison, this can lead to an erroneous judgement of the authenticity of the respective bank note.

In a luminescence sensor, a blocking filter is usually installed in the detection ray path of the detector, which suppresses the excitation light as much as possible, e.g. to a factor of $T^*=10^{-5}$, so that as little excitation light as possible reaches the detector. However, since a complete suppression of the excitation light is not achieved despite the blocking filter, but a considerable intensity is used for the excitation light, a part of the excitation light A usually still advances to the detector. The excitation light advancing to the detector— despite the blocking filter—can have an intensity comparable to the luminescence to be detected, as is shown in the case of FIG. 3*c*.

It has been found that the problem of distortion of the remission measurement values MR (due to the luminescence occurring simultaneously) can be solved in that no blocking filter is used in the detection ray path 8 for the excitation light A, but a larger portion of the excitation light A is allowed to pass through to detector 6. In the detection ray path 8 of the sensor 10 there is installed a spectral detection filter 5—instead of the blocking filter—which suppresses the excitation light only partially, e.g. only to a factor of $T=10^{-2}$, and not—as otherwise usual—as strongly as possible. The low attenuation of the excitation light A in the detection ray path 8 leads to the fact that the portion of detected excitation intensity is significantly increased, while the contribution of luminescence (which leads to distortion) remains the same—due to the unchanged excitation intensity of the bank note—(the excitation intensity impinging on the bank note is not influenced by the changed attenuation in the detection ray path). Since the excitation intensity passed through to the detector is then much greater—due to the lower attenuation—than the (distorting) contribution which the luminescence intensity makes to the remission measurement value, the luminescence then only leads to a negligible distortion of the remission measurement value.

Figure 3C:
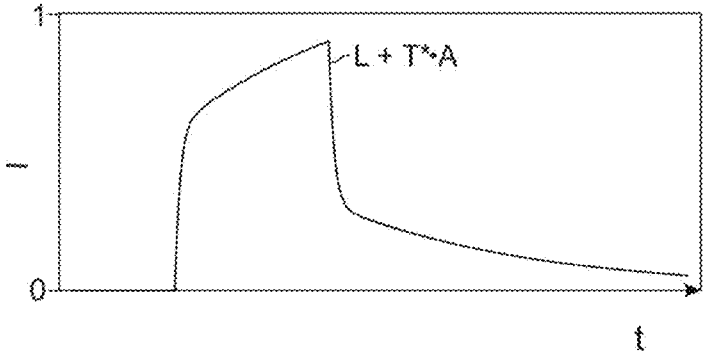

FIG. 3*c* is the time course of the intensity impinging on the detector 6 in the hitherto usual case of an as strong an attenuation as possible of the excitation light (transmission of the spectral detection filter 5 of $T^*=10^{-5}$).

Figure 3D:
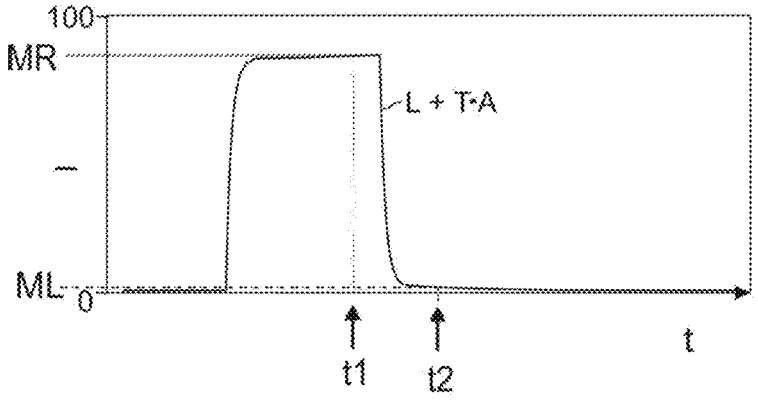

And in FIG. 3*d* the time course of the intensity impinging on detector 6 is shown in the case of a lower attenuation of the excitation light (transmission of the spectral detection filter 5 of $T=10^{-2}$). When comparing FIGS. 3*c* and 3*d*, it can be recognized that in the case of the strong attenuation, the remission measurement value MR detected at the point in time t1 is clearly distorted by the luminescence L. In the case of the lower attenuation, however, the remission measurement value MR detected at the point in time t1 remains nearly undistorted by the luminescence L. At the point in time t2 the luminescence measurement value ML is detected. The descending branch of the luminescence curve in FIG. 3*d* corresponds to that in FIG. 3*c*, but the larger y-scaling in FIG. 3*d* leads to the fact that the descending branch of the luminescence curve and thus also the luminescence measurement value ML are further down on the y-axis. In the larger y-scaling in FIG. 3*d* one can also recognize that the remission measurement value MR detected at the point in time t1 is strongly increased compared to the case in FIG. 3*c*.

If the luminescent substance of the bank note to be detected rises slowly over time (i.e. does not excessively distort the remission measurement value), the transmission of the spectral detection filter for the excitation light need not be increased as much. Then both the increased remission measurement value MR and the significantly lower luminescence measurement value ML can be detected with sufficient accuracy with the same detector 6. Where applicable, a special detector 6 can be used, which has a particularly large dynamic region.

Figure 6:
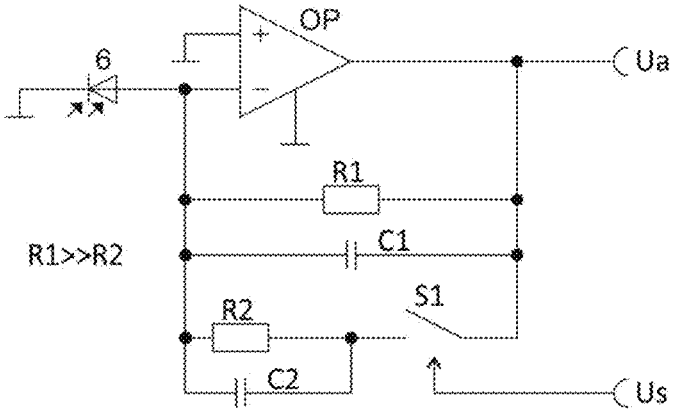

If the luminescent substance of the bank note to be detected rises quickly over time (i.e. strongly distorts the remission measurement value), a significantly increased transmission of the spectral detection filter for the excitation light is necessary. To avoid overdriving the measurement in this case, a dynamic sensitivity switchover can be performed during the measurement. For example, for this purpose a current-voltage converter with switchable amplification is used, see the electronic circuit shown in FIG. 6. The control device 7 of the sensor 10 ensures a switchover of the amplification of the current-voltage converter with the aid of a semiconductor switch S1, which is selectively set to either the open or the closed state via a control signal Us of the control device 7. During the illumination with an excitation light pulse S1 is closed, so that the low-resistance resistor R2 is connected in parallel to the high-resistance resistor R1. For the detection of the remission measurement value MR, the current-voltage converter then has a low amplification. After the detection of the remission measurement value MR, the control device 7 opens the semiconductor switch S1 with the aid of the control signal Us, so that the current-voltage converter—for the detection of the low luminescence measurement value ML—has a large amplification. To avoid overdriving states, the timing of the control signal Us is preferably laid such that the semiconductor switch S1 is already closed before the start of the excitation light pulse and is only opened again after the end of the excitation light pulse.

For an increased stability of the electronic circuit, capacitors can be used which are connected in parallel to the resistors. By a corresponding selection of the capacitors additionally the amplification bandwidth can be set. The capacitance values C1 and C2 of the capacitors can be selected, for example, in accordance with the following formula:

$$C_x = \frac{1}{4\pi R_x f_c}\left(1 + \sqrt{1 + 8\pi R_x f_c C_i}\right)$$

with $R_x$=R1 or R2 and $C_x$=C1 or C2 fc=amplification bandwidth product of the operational amplifier OP

Ci=sum of photodiode capacity and OP input capacity.

In order to detect a low luminescence measurement value very shortly after the illumination with the intense excitation light pulse, a semiconductor detector with a highly doped substrate is preferably used as a detector 6, for example a silicon photodiode with a highly doped Si substrate. In particular, a semiconductor detector is used whose substrate has a charge carrier lifetime that is significantly shorter than the time interval between the excitation light pulse and the detection of the luminescence measurement value ML. Preferably, the charge carrier lifetime in the substrate of the semiconductor detector is at most 20 μs, particularly preferably at most 10 μs. This achieves that the luminescence measurement value ML can be detected in a very short time interval after the end of the excitation light pulse, e.g. already 50 μs-200 μs after the end of the excitation light pulse. This makes possible, even at high transport speeds of the bank note, that the detection region of the remission measurement (first detection region D1) and the detection region of the luminescence measurement (second detection region D2) overlap strongly in terms of area, e.g. by at least 80%, see FIG. 5.

Figure 4A:
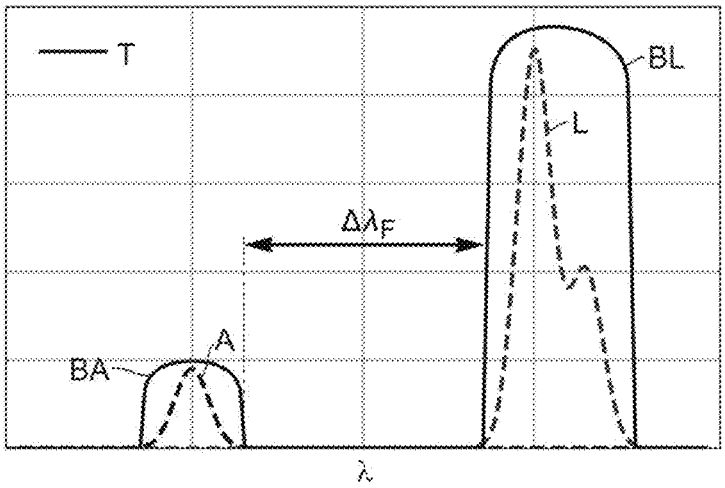

In FIG. 4*a* there is shown an example of the spectral course of the excitation light A used for exciting the bank note and the luminescent light L emitted by the bank note. In addition, in FIG. 4*a* there is shown by way of example a transmission spectrum T of a spectral detection filter 5 which is located in the detection ray path 8 of the sensor 10. The transmission spectrum T in FIG. 4*a* has a spectral luminescence transmission band BL in the spectral region of the luminescence light L and an additional spectral transmission band BA in the spectral region of the excitation light A, which spectrally completely encloses the spectral excitation band of the excitation light A. The transmission band BL likewise can completely enclose the luminescent light, but alternatively allows only a spectral portion of the luminescent light L to pass through.

The spectral detection filter 5 allows for example 20% of the excitation light to pass through in the additional spectral transmission band BA, and in the spectral luminescence transmission band BL 95%. The spectral distance $\Delta\lambda_F$ of the two transmission bands BA and BL, measured at the half-value points of the respective transmission bands BA and BL, is preferably at least 10 nm, see FIG. 4*a*. For example, as a spectral detection filter 5 there is used an interference filter, in which the transmission bands BL and BA are selected according to the spectral location of the luminescent light L and of the excitation light A.

The transmission spectrum T of the spectral detection filter 5 can have different shapes. For example, the additional spectral transmission band BA can be positioned symmetrically or asymmetrically around the spectral curve of the excitation light A. In FIG. 4*b-e* there are shown four examples of the additional spectral transmission band BA, which only partially overlap with the spectral excitation band of excitation light A. The additional spectral transmission band BA can lie e.g. in the upper spectral flank of the excitation light A (cf. FIG. 4*b*) or in the lower spectral flank of the excitation light A (cf. FIG. 4*c*).

Figure 4C:
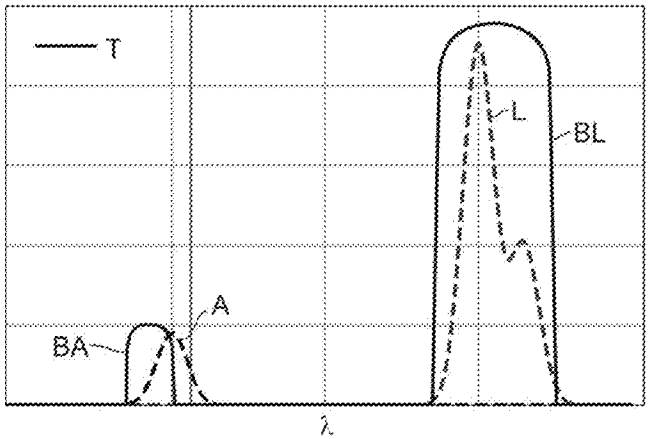
Figure 4B:
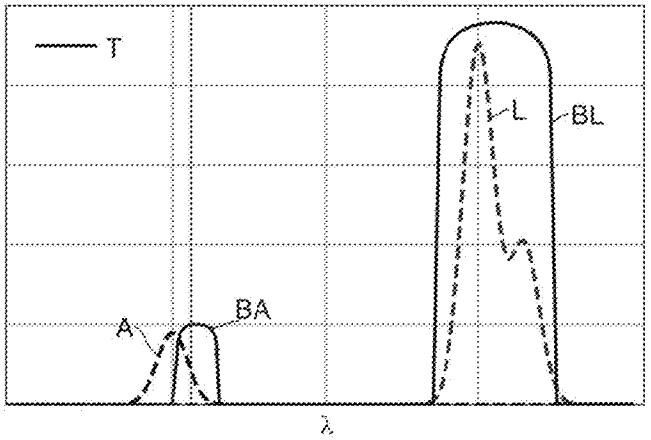
Figure 4E:
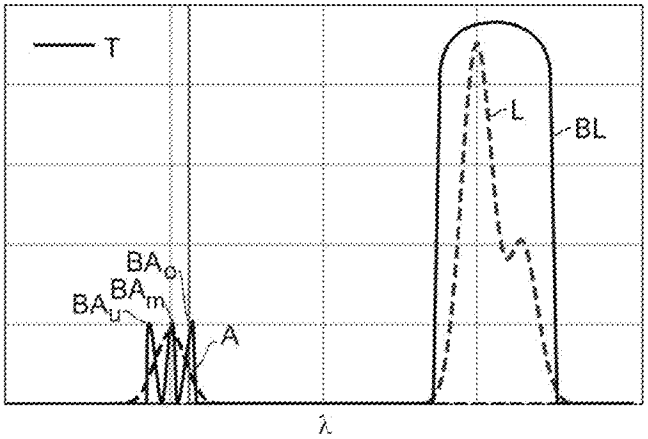
Figure 4D:
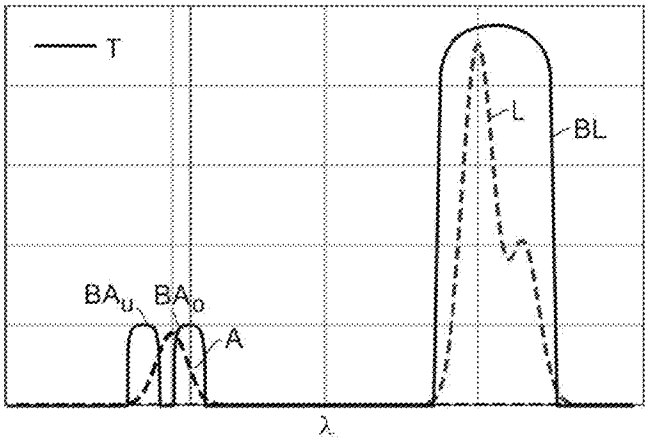

The spectral shape of the additional spectral transmission bands of FIGS. 4*d* and 4*e* is selected such that the spectral detection filter 5 in both spectral flanks of the excitation light A respectively has an additional spectral transmission band, namely a first additional transmission band $BA_u$ which lies spectrally in the lower spectral flank of the excitation light A and a second additional transmission band $BA_o$ which lies spectrally in the upper spectral flank of the excitation light A. This achieves that the intensity of the excitation light A transmitted through the spectral filter 5 is not changed even in the event of any spectral drift of the excitation light A (which may occur, e.g. due to a change in temperature). Because, for example, a spectral shift of the spectral excitation band to longer wavelengths would lead to an increased intensity in the transmission band $BA_o$ of the long-wave flank and to a reduced intensity in the transmission band $BA_u$ of the short-wave flank. This means, both changes are opposite to each other and at least partially compensate one another. In contrast, one single additional transmission band in only one of the two flanks would be less favourable, since no such compensation would be effected. Optionally, also a third additional transmission band $BA_m$ may be present in the spectral center of the excitation light.

The invention claimed is:

1. A sensor for checking the authenticity of documents, comprising:

an illumination device for illuminating a document with one or several excitation light pulses of an excitation light which is suitable to excite the document to emit luminescent light; and a detector for detecting at least one remission measurement value of the document and at least one luminescence measurement value of the document; and a detection filter which is located in a detection ray path formed between the document and the detector; and a control device for controlling the illumination device and the detector, wherein the control device is arranged to drive the detector such that the detector detects at least one remission measurement value of the document at at least one point in time at which the document is illuminated with an excitation light pulse of the excitation light, and detects at least one luminescence measurement value of the document at at least one point in time after the end of the respective excitation light pulse;

an evaluation device for checking the document on the basis of the at least one remission measurement value detected by the detector and on the basis of the at least one luminescence measurement value detected by the detector;

wherein the detection filter is a spectral detection filter whose spectral transmission is selected such that both the luminescent light of the document impinging on the spectral detection filter and at least 0.5% of the excitation light impinging on the spectral detection filter are transmitted through the spectral detection filter;

wherein the remission of the excitation light irradiated for the luminescence measurement is detected for the at least one remission measurement value.

2. The sensor according to claim 1, wherein the spectral transmission of the spectral detection filter is selected such that at least 80% of the luminescent light of the document impinging on the spectral detection filter is transmitted through the spectral detection filter.

3. The sensor according to claim 1, wherein a maximum transmission which the spectral detection filter has in the spectral region of the luminescent light is greater by at least a factor of 4 than a maximum transmission which the spectral detection filter has in the spectral region of the excitation light.

4. The sensor according to claim 1, wherein the spectral detection filter has a transmission spectrum which has a spectral luminescence transmission band in the spectral region of the luminescent light of the document and at least one additional spectral transmission band in the spectral region of the excitation light.

5. The sensor according to claim 4, wherein the at least one additional transmission band spectrally overlaps with the excitation light or spectrally completely encloses the excitation light.

6. The sensor according to claim 4, wherein the spectral detection filter has a greater transmission in its luminescence transmission band than in its at least one additional transmission band.

7. The sensor according to claim 4, wherein the additional transmission band has a spectral distance from the luminescence transmission band of at least 10 nm.

8. The sensor according to claim 4, wherein the excitation light has a spectral excitation band with an upper spectral flank and a lower spectral flank, and the spectral detection filter has a first additional spectral transmission band, which lies spectrally in the lower spectral flank of the excitation band and has a second additional spectral transmission band which lies spectrally in the upper spectral flank of the excitation band.

9. The sensor according to claim 1, wherein the control device is arranged to drive the detector, or an electronic circuit connected therewith such that the respective remission measurement value is measured with lower sensitivity than the respective luminescence measurement value.

10. The sensor according to claim 9, wherein the control device is arranged to switch over a sensitivity setting of the detector or of an amplifier connected with the detector or of a current-voltage converter connected with the detector in the time period between the detection of the respective remission measurement value and the respective luminescence measurement value such that the remission measurement value is measured with lower sensitivity than the luminescence measurement value.

11. The sensor according to claim 1, wherein the detector is a semiconductor-based detector with a charge carrier lifetime of at most 20 μs.

12. An apparatus for checking a document with a sensor according to claim 1.

13. The apparatus according to claim 12 having a transport device which is arranged to transport the document and the detector relative to each other during the detection of the remission and luminescence measurement value, wherein the control device of the sensor is arranged to drive the detector such that the respective remission measurement value and the respective luminescence measurement value are detected with such a short time interval between each other that the detection regions on the document, from which the respective remission measurement value and the respective luminescence measurement value are detected, overlap by at least 50%.

14. A method for checking the authenticity of the documents, comprising the steps of:

illuminating a document with one or several excitation light pulses of an excitation light which is suitable to excite the document to emit luminescent light;

detecting at least one remission measurement value of the document at at least one point in time at which the document is illuminated with an excitation light pulse of the excitation light, by means of a detector;

detecting at least one luminescence measurement value of the document at at least one point in time after the end of the respective excitation light pulse by means of the detector;

checking the document on the basis of the at least one remission measurement value detected by the detector and on the basis of the at least one luminescence measurement value detected by the detector;

wherein in a detection ray path formed between the document and the detector there is located a spectral detection filter whose spectral transmission is selected such that both the luminescent light of the document impinging on the spectral detection filter and at least 0.5% of the excitation light impinging on the spectral detection filter, which has been remitted by the document, is transmitted through the spectral detection filter;

wherein the remission of the excitation light irradiated for the luminescence measurement is detected for the at least one remission measurement value.

15. The method according to claim 14, wherein the document and detector are transported relative to each other during detection and that the remission measurement value and the luminescence measurement value are detected with such a small-time interval between each other that the detection regions on the document, from which the respective remission measurement value and the respective luminescence measurement value are detected, overlap by at least 50%.

16. A sensor for checking the authenticity of documents, comprising:

an illumination device for illuminating a document with one or several excitation light pulses of an excitation light which is suitable to excite the document to emit luminescent light; and a detector for detecting at least one remission measurement value of the document and at least one luminescence measurement value of the document; and a detection filter which is located in a detection ray path formed between the document and the detector; and a control device for controlling the illumination device and the detector, wherein the control device is arranged to drive the detector such that the detector detects at least one remission measurement value of the document at at least one point in time at which the document is illuminated with an excitation light pulse of the excitation light, and detects at least one luminescence measurement value of the document at at least one point in time after the end of the respective excitation light pulse;

an evaluation device for checking the document on the basis of the at least one remission measurement value detected by the detector and on the basis of the at least one luminescence measurement value detected by the detector;

wherein the detection filter is a spectral detection filter whose spectral transmission is selected such that both the luminescent light of the document impinging on the spectral detection filter and at least 0.5% of the excitation light impinging on the spectral detection filter are transmitted through the spectral detection filter;

wherein the control device is arranged to drive the detector, or an electronic circuit connected therewith such that the respective remission measurement value is measured with lower sensitivity than the respective luminescence measurement value; and wherein the control device is arranged to switch over a sensitivity setting of the detector or of an amplifier connected with the detector or of a current-voltage converter connected with the detector in the time period between the detection of the respective remission measurement value and the respective luminescence measurement value such that the remission measurement value is measured with lower sensitivity than the luminescence measurement value.

* * * * *